US005365858A

United States Patent [19]

Kuhns

[11] Patent Number: 5,365,858

[45] Date of Patent: Nov. 22, 1994

[54] PLASTIC PALLET INCORPORATING ELECTROSTATIC DISCHARGE ELEMENT

[75] Inventor: Joseph H. Kuhns, Glen Allen, Va.

[73] Assignee: Reynolds Metals Company, Richmond, Va.

[21] Appl. No.: 41,744

[22] Filed: Apr. 1, 1993

[51] Int. Cl.[5] ..... B65D 19/44

[52] U.S. Cl. ..... 108/55.3; 108/55.5; 108/901

[58] Field of Search ..... 108/55.1, 51.1, 55.5, 108/901, 55.3; 174/6; 361/224, 220

[56] References Cited

U.S. PATENT DOCUMENTS

| | | | |
|---|---|---|---|
| T886,012 | 5/1971 | Small | 108/51 |
| 1,770,614 | 7/1930 | Hennessy . | |
| 3,199,469 | 8/1965 | Sullivan | 108/53 |
| 3,467,032 | 9/1969 | Rowlands et al. | 108/51 |
| 3,667,403 | 6/1972 | Angelbeck, Jr. | 108/58 |
| 3,710,733 | 1/1973 | Story | 108/51 |
| 4,013,021 | 3/1977 | Steinlein et al. | 108/51.1 |
| 4,103,857 | 8/1978 | Levenhagen | 248/346 |
| 4,316,419 | 2/1982 | Cupido | 108/56.1 |
| 4,727,452 | 2/1988 | Brownlee | 361/224 |
| 4,782,763 | 11/1988 | Sailoum | 108/55.3 |
| 4,966,083 | 10/1990 | Cerugeira | 108/56.1 |
| 5,007,352 | 4/1991 | Calkoen | 108/56.1 |
| 5,031,776 | 7/1991 | Morgan, IV | 206/600 |
| 5,086,927 | 2/1992 | Bach et al. . | |
| 5,178,075 | 1/1993 | Kanazawa | 108/56.1 |

FOREIGN PATENT DOCUMENTS

| | | | |
|---|---|---|---|
| 3343656 | 7/1985 | Germany | 174/6 |
| 3075243 | 4/1988 | Japan | 361/220 |
| 0148448 | 6/1991 | Japan | 108/51.1 |
| 0147838 | 11/1954 | Sweden | 108/51.1 |
| 0638802 | 6/1950 | United Kingdom | 108/51.1 |
| 0711810 | 7/1951 | United Kingdom | 108/51.1 |

*Primary Examiner*—Kenneth J. Dorner
*Assistant Examiner*—Gerald A. Anderson
*Attorney, Agent, or Firm*—Alan M. Biddison

[57] ABSTRACT

A plastic pallet having an upper, article-receiving and supporting surface and a lower surface in contact with the ground. The pallet includes a conductive element that extends from the upper surface to the lower surface to define a continuous conductive path between the surfaces to conduct to the ground static electrical charges that build up on the pallet and on the article or articles carried on the pallet. The conductive element can be in the form of a metallic rod or wire, or in the form of a plurality of conductive particles, such as metal or carbon particles that are carried in a suitable binder material.

12 Claims, 2 Drawing Sheets

PLASTIC PALLET INCORPORATING ELECTROSTATIC DISCHARGE ELEMENT

BACKGROUND OF THE INVENTION

1. FIELD OF THE INVENTION

The present invention relates to plastic shipping pallets for shipping large items, such as coils of metallic aluminum sheet, and more particularly to a plastic shipping pallet that includes an integral electrical conductor for discharging or dissipating to ground static electrical charges accumulated by the pallet or by the load thereon.

2. DESCRIPTION OF THE RELATED ART

Shipping pallets serving as base members to which large items are strapped or otherwise attached for shipment have been in use for a number of years. In the past such pallets were most often constructed of wood, usually because of the rigidity, weight, cost, and availability attendant with the use of that material. Recently, however, more and more of such shipping pallets are being made from molded plastic, because plastics are low in cost, because plastics can be easily and quickly molded to provide a pallet having virtually any desired size and configuration, because plastics pallets can be configured to be as strong and also lighter than wood pallets to support the same shape and weight items, and because plastics pallets are readily recyclable when they are damaged and no longer usable. The recyclability aspect is a significant factor affecting the total cost involved for plastics pallets, because damaged wood pallets are usually disposed of in landfills, a disposal method that is becoming increasingly more expensive.

Because plastics in general have a very low electrical conductivity, they are often used when insulating properties are desired. However, in a number of applications in which plastics are used their low conductivity results in a buildup of static electrical charge. Such static charges can attain significant voltages, of the order of up to about ½ million volts or so. Clearly, such charges on plastic shipping pallets are undesirable, because they can discharge and cause sparks in areas where combustible vapors or gases exist, and they cause uncomfortable shocks to personnel unloading or otherwise handling the items carried on pallets made from plastics.

Although plastic pallets are known, see, e.g., U.S. Pat. Nos. 4,103,857; 4,316,419; 4,966,083, and 5,178,075; there appear not to have been disclosed in any of those patents a plastic pallet that is capable of preventing the buildup on the pallet, and on the load attached thereto, of large charges of static electricity.

Accordingly, it is an object of the present invention to provide a plastic pallet including an integral conductive path for safely and simply discharging from the pallet and its load any accumulated large charges of static electricity.

SUMMARY OF THE INVENTION

Briefly stated, in accordance with one aspect of the present invention, a molded plastic pallet is provided, the pallet including an article-receiving platform having an upper surface, and having a lower surface to enable the pallet to rest on and to contact the ground. An electrically conductive element extends through the platform from the upper surface to the lower surface for providing a continuous conductive path from the upper surface of the platform to the ground for discharging static electrical charges carried both by the pallet and by an article supported on the upper surface of the platform.

In accordance with another aspect of the present invention, the electrically conductive element is a metallic, rod-like member that extends completely through the plastic pallet from the upper surface to the ground-contacting surface.

BRIEF DESCRIPTION OF THE DRAWINGS

FIG. 3 is a cross-sectional view of the pallet shown in FIG. 3, taken along the line 5-5 thereof, but without the coil of material.

DESCRIPTION OF THE PREFERRED EMBODIMENTS

Figure 1:
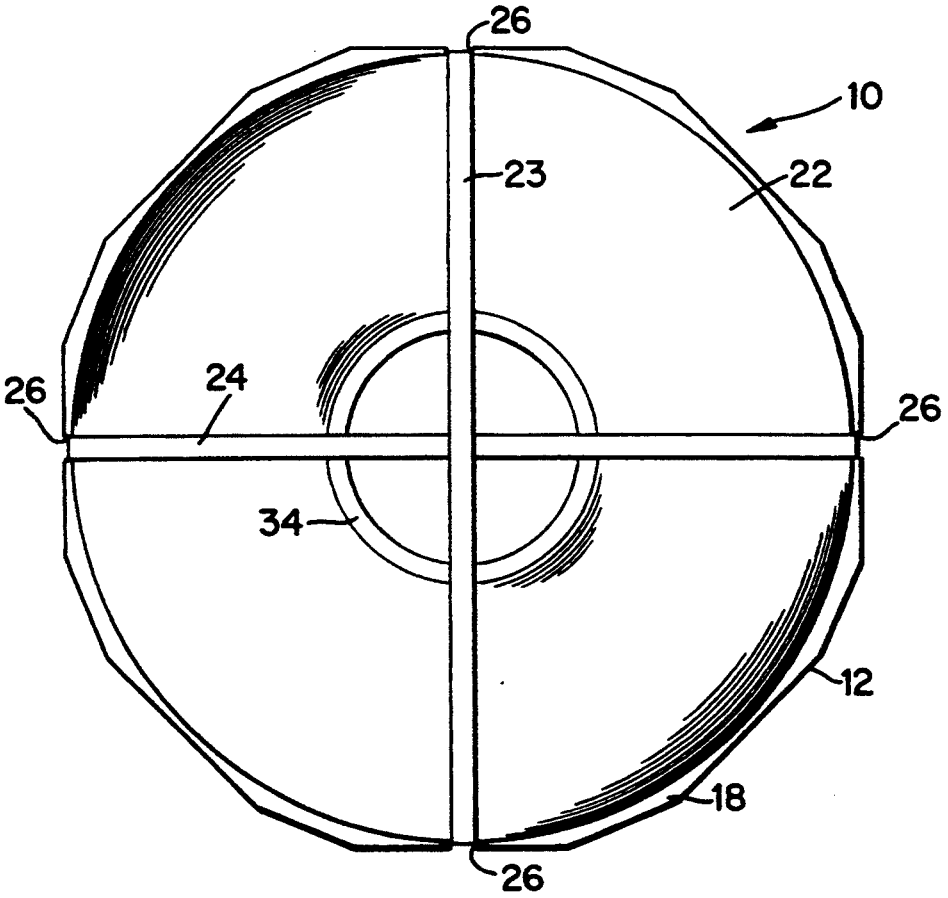
FIG. 1 is a top plan view of a molded, unitary plastic pallet in accordance with the present invention, wherein the pallet supports a coil of metallic material that is banded to the pallet.
Figure 2:
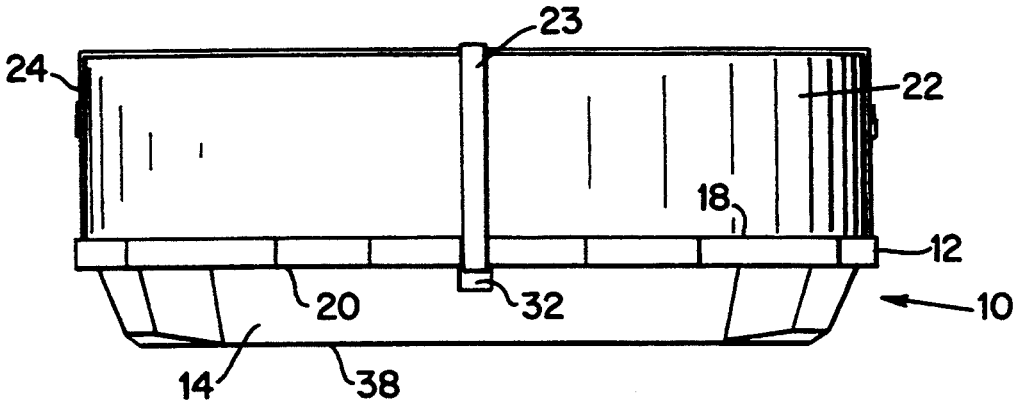
FIG. 2 is a side elevational view of the pallet and coil shown in FIG. 1.
Figure 3:
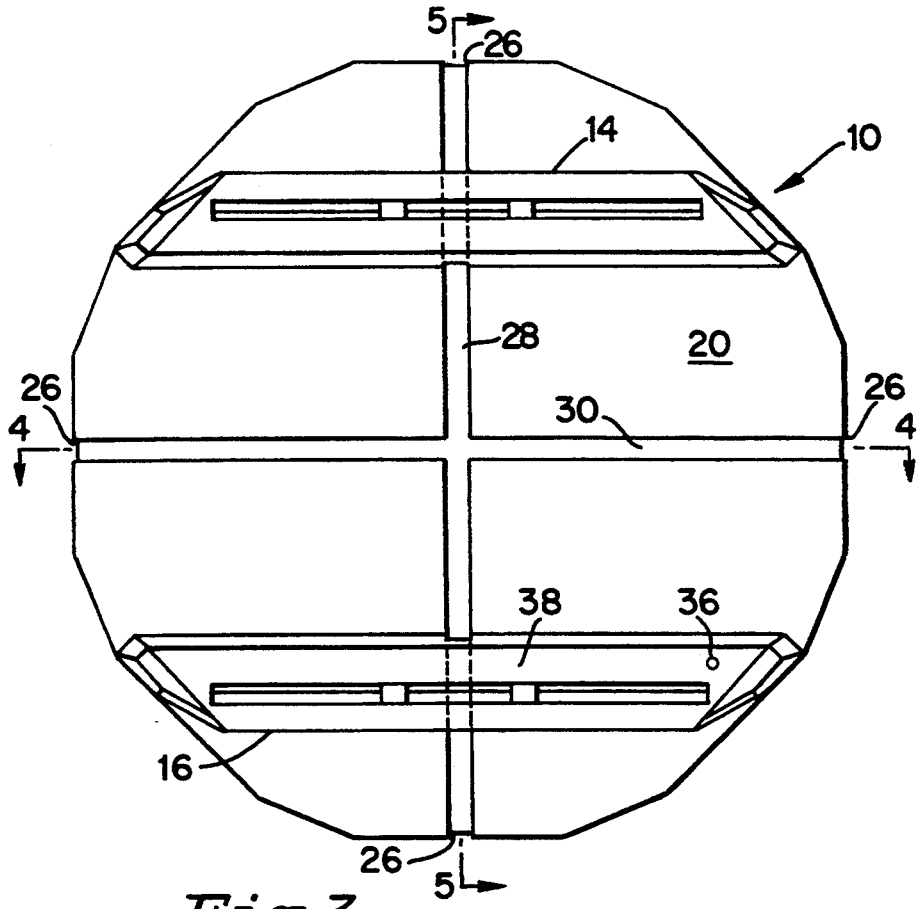
FIG. 3 is a bottom plan view of the pallet shown in FIG. 1.

Referring now to the drawings, and particularly to FIGS. 1 and 2 thereof, there is shown a pallet 10 including a load-carrying platform 12 and a pair of laterally spaced, parallel, elongated legs 14 and 16 (see FIG. 3). Platform 12 includes a substantially flat, upper, article-receiving surface 18 that carries the load to be supported by the pallet, and a lower surface 20 from which legs 14 and 16 depend and with which the legs are preferably integrally formed, such as by injection molding. As used herein, the term "pallet" includes any form of tray, platform, or carrier for supporting, storing, and transporting by rail or truck various types of goods and articles, and it also includes platforms and other structures sometimes referred to as "skids."

As shown in FIGS. 1 and 2, pallet 10 supports on its upper surface 18 a coil 22, such as a coil of metallic sheet, for example a coil of aluminum sheet, or the like. As shown, platform 12 is of generally octagonal shape, although it can be of any other desired shape, such as square, rectangular, circular, or the like, as desired, and as necessary to support the goods or articles intended to be carried on pallet 10.

The material from which pallet 10 is made is a plastic material. Suitable plastics include high density polyethylene, polypropylene, or the like, preferably plastics that have the necessary toughness and rigidity when molded to adequately support and carry the load intended to be carried by the pallet, and also to withstand the rough handling to which shipping pallets are typically subjected in use.

Coil 22 is retained on pallet 10 by straps 23 and 24 that pass over coil 22, and around the edges of and beneath platform 12 in a continuous loop, as will be appreciated by those having skill in the art. Straps 23 and 24 can be made from metal, fabric, or plastic, and they are preferably disposed at right angles to each other to securely hold and restrain coil 22. As best seen in FIGS. 1 and 3, platform 12 includes two pairs of diametrically opposed, inwardly extending notches 26 formed in the edge of the platform to receive the respective straps 23 and 24 and to restrain the straps from circumferential slippage as pallet 10 is being transported.

As shown in FIG. 3, in addition to notches 26, pallet 10 also includes linear grooves 28 and 30 formed in lower surface 20 of platform 12 to serve as guides and retainers for straps 23 and 24, respectively. Additionally, legs 14 and 16 include passageways 32, which are aligned with groove 28 and through which strap 23 passes.

Figure 4:
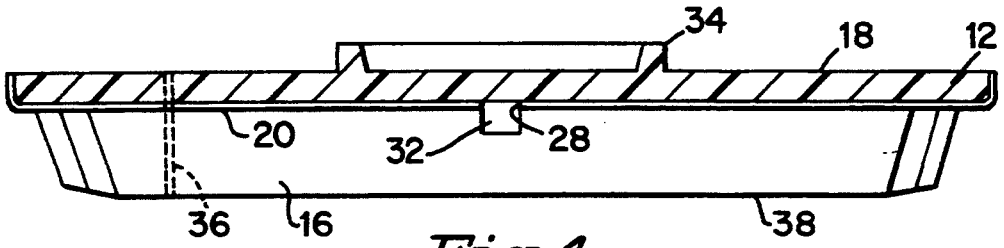
FIG. 4 is a cross-sectional view of the pallet shown in FIG. 3, taken along the line 4-4 thereof, but without the coil of material.
Figure 5:
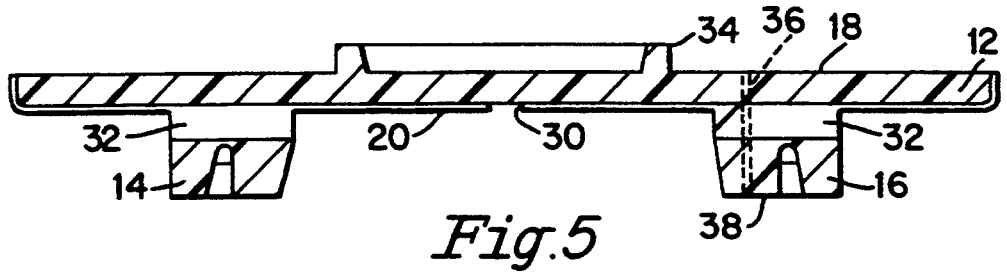

As shown in FIGS. 1, 4, and 5, platform 12 includes on upper surface 18 an upwardly extending, annular centering ring 34, that is adapted to be received within the central opening of coil 22. Centering ring 34 serves to position coil 22 centrally on upper surface 18 of pallet 10 and to restrain coil 22 from excessive transverse slippage along upper surface 18 of pallet 10.

As best seen in FIGS. 3, 4, and 5, an electrically conductive element 36 extends through pallet 10 from upper surface 18 of platform 12 to lower surface 38 of leg 16. Lower surface 38 is in contact with the ground when pallet 10 is not being transported and is not resting on another pallet. Conductive element 36 serves to provide a low resistance path between upper surface 18 of pallet 10 and the ground to allow discharge or dissipation of any static electrical charge that might form on upper surface 18 or on the load that is carried on upper surface 18. Such charge, for instance, can become quite high when plastic wrapping is removed from an aluminum coil carried by the pallet.

Conductive element 36 can be a metallic member, such as a metallic rod of steel, aluminum, copper, or the like, that is a good electrical conductor. The diameter of such a rod can be any convenient diameter, as it is only necessary to provide a continuous conductive path between upper surface 18 and the ground in order to carry away and dissipate any static electrical charge that builds up on surface 18 or on the load carried thereon. Consequently, such a rod can be as large as ¼ inch (3.175 mm.) or more in diameter to as little as about 1/64 inch (0.397 mm.), and it can also be provided in the form of a single or a braided wire, such as, for example, a wire of 12 or 14 gauge.

Figure 6:
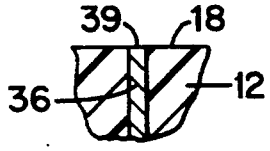
FIG. 6 is an enlarged, fragmentary, cross-sectional view through a portion of the upper surface of a plastic pallet in accordance with the present invention, showing the position of an end of a conductor carried by the pallet, wherein the end of the conductor is positioned flush with the adjacent surface of the pallet.
Figure 7:
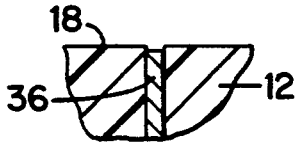
FIG. 7 is an enlarged, fragmentary, cross-sectional view, similar to FIG. 6, through a portion of the upper surface of a plastic pallet in accordance with the present invention, showing the position of an end of a conductor carried by the pallet, wherein the end of the conductor is recessed slightly inwardly from the adjacent surface of the pallet.

Preferably, conductive element 36 has an end 39 that is substantially flush with upper surface 18, as shown in FIG. 6. Both ends of conductive element 36 are so positioned relative to the adjacent upper and lower surfaces of the pallet structure so that each of the ends of element 36 is substantially in contact with either the article or articles carried by pallet 10 as well as with the ground. However, if it is desired to space the ends of conductive element 36 slightly inwardly of the adjacent surfaces, to avoid possible interference with free sliding movement of either the load relative to upper surface 18 of pallet 10, or of pallet 10 relative to the ground, spacing the ends of element 36 inwardly of the respective surfaces of the pallet is possible, for instance, by a distance of up to about 1/32 inch (0.794 mm.), as illustrated generally in exaggerated form in FIG. 7. Such spacing will still permit dissipation of a static charge buildup, particularly if the charge is of a relatively high voltage level that can jump the gap between the charged surface on the end of conductive element 36.

Figure 8:
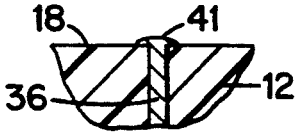
FIG. 8 is an enlarged, fragmentary, cross-sectional view, similar to FIG. 6, through a portion of the upper surface of a plastic pallet in accordance with the present invention, showing the position of an end of a conductor, wherein the end extends slightly outwardly from the adjacent surface of the pallet.

If it is desired to insure direct contact between the load carried by pallet 10 and the ground, conductive element 36 can be made longer than the distance from upper surface 18 of pallet 10 to lower surface 38. In that instance the ends 41 of element 36 can then be peened over to assume the form illustrated in FIG. 8, if desired, to provide greater surface contact area at the ends of conductive element 36.

In addition to providing conductive element 36 in the form of a solid, metallic member, conductive element 36 can also be provided in the form of a plurality of conductive particles, such as metal particles, carbon particles, or the like, that are contained within a suitable binder. However, to insure a continuous conductive path for the flow of the electrical charge, either a sufficient number of the particles must be in physical contact with each other to provide a continuous, uninterrupted conductive path having a resistance of 100,000 ohms or less from one end of conductive member 36 to the other end, or the particles must be enclosed within a suitable electrically conductive binder material.

If the conductive element is a solid material, and if it has sufficient strength and rigidity, it can be physically driven into pallet 10, after the pallet has been molded, to assume the position shown in the drawings. Alternatively, the element can be positioned within a mold cavity in which the pallet is molded, and the heated, viscous plastic material can be injected into the mold cavity to flow around the element to enclose it and hold it in position after cooling and solidification of the plastic. In either event, although it is embedded within the pallet structure, conductive member 36 is not itself a structural, load-carrying member, but serves merely as an electrical conductor.

If conductive element 36 is intended to be provided in the form of an aggregation of conductive particles, a passageway can be formed in pallet 10 by placing a core pin within the pallet mold in the position shown in FIGS. 3 through 5. The core pin is removed from the molded pallet after molding, and the particulate material can be inserted in the passageway. Alternatively, the passageway through the pallet can be formed by drilling a hole through the pallet at an appropriate position. The conductive particles can be mixed with a suitable binder and can be introduced into the passageway to fill it and thereby provide the electrical conductive path upon solidification of the binder material.

It can thus be seen that the present invention provides distinct advantages over the prior art structures, and it also provides a positive method for minimizing, if not eliminating, undesired static electrical charges on shipping pallets and on the loads carried on such pallets.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A plastic pallet for holding a coil of metal protected by plastic wrapping comprising:

a) a platform having an article-receiving upper surface and having a lower surface for contacting the ground;

b) positioning means extending upwardly from said upper surface for positioning a coil centrally on said upper surface and for restraining excessive transverse slippage of the coil along said upper surface; and c) a non-load-bearing, non-structural electrically conductive element extending through the platform from the upper surface thereof to the lower surface thereof for providing a conductive path to discharge to ground static electrical charges generated when plastic wrapping is removed from a coil carried by the pallet.

2. A plastic pallet in accordance with claim 1 that is a one piece molded pallet.

3. A plastic pallet in accordance with claim 1 wherein the conductive element includes first and second ends adjacent the upper and lower surfaces, respectively, and wherein at least one of the first and second ends is spaced inwardly of the respective pallet upper and lower surfaces.

4. A plastic pallet in accordance with claim 3 wherein the spacing between the at least one of the first and second ends and the respective upper and lower pallet surfaces is a distance of up to about 1/32 inch.

5. A plastic pallet in accordance with claim 1 wherein the conductive element includes first and second ends adjacent the upper and lower surfaces, respectively, and wherein the first and second ends are substantially flush with the respective pallet upper and lower surfaces.

6. A plastic pallet in accordance with claim 1 wherein the conductive element includes first and second ends adjacent the upper and lower surfaces, respectively, and wherein the first and second ends extend outwardly of the respective pallet upper and lower surfaces.

7. A plastic pallet in accordance with claim 6 wherein the conductive element is metallic.

8. A plastic pallet in accordance with claim 7 wherein the conductive element is a metallic rod.

9. A plastic pallet in accordance with claim 7 wherein the conductive element is a metallic wire.

10. A plastic pallet in accordance with claim 1 wherein the conductive element includes a plurality of conductive particles that define a conductive path through the pallet.

11. A plastic pallet in accordance with claim 1 wherein the conductive particles are carbon particles.

12. A plastic pallet in accordance with claim 1 wherein the conductive particles are metallic particles.

* * * * *